US010413789B1

(12) United States Patent
Seluga et al.

(10) Patent No.: US 10,413,789 B1
(45) Date of Patent: Sep. 17, 2019

(54) GOLF CLUB HEAD WITH FACE DAMPING AND STRESS-REDUCTION FEATURES

(71) Applicant: Callaway Golf Company, Carlsbad, CA (US)

(72) Inventors: James A. Seluga, Carlsbad, CA (US); Matthew Myers, Carlsbad, CA (US); Denver Holt, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 16/230,942

(22) Filed: Dec. 21, 2018

Related U.S. Application Data

(63) Continuation-in-part of application No. 16/026,382, filed on Jul. 3, 2018, now Pat. No. 10,173,109, which is a continuation of application No. 15/821,557, filed on Nov. 22, 2017, now Pat. No. 10,039,965.

(51) Int. Cl.

| | |
|---|---|
| ***A63B 53/08*** | (2015.01) |
| ***A63B 53/04*** | (2015.01) |
| ***A63B 60/42*** | (2015.01) |
| ***A63B 60/54*** | (2015.01) |
| *A63B 102/32* | (2015.01) |

(52) U.S. Cl.
CPC ..... *A63B 53/0475* (2013.01); *A63B 60/42* (2015.10); *A63B 60/54* (2015.10); *A63B 53/047* (2013.01); *A63B 53/08* (2013.01); *A63B 2053/0416* (2013.01); *A63B 2053/0425* (2013.01); *A63B 2053/0495* (2013.01); *A63B 2102/32* (2015.10)

(58) Field of Classification Search
CPC ..... A63B 60/54; A63B 53/0475; A63B 53/08; A63B 53/047; A63B 2053/0416; A63B 2053/042; A63B 2053/0495
USPC ..... 473/342, 332, 333
See application file for complete search history.

(56) References Cited

U.S. PATENT DOCUMENTS

| | | | | |
|---|---|---|---|---|
| 5,820,481 | A * | 10/1998 | Raudman | A63B 53/0487 473/313 |
| 6,354,961 | B1 * | 3/2002 | Allen | A63B 53/04 473/329 |
| 7,922,604 | B2 * | 4/2011 | Roach | A63B 53/047 473/350 |
| 9,480,888 | B1 * | 11/2016 | Allen | A63B 53/047 |
| 10,039,965 | B1 * | 8/2018 | Seluga | A63B 53/0475 |
| 10,173,109 | B1 * | 1/2019 | Seluga | A63B 53/0475 |
| 2010/0113178 | A1 * | 5/2010 | Stites | A63B 53/0466 473/329 |

(Continued)

*Primary Examiner* — Benjamin Layno
(74) *Attorney, Agent, or Firm* — Rebecca Hanovice; Michael Catania; Sonia Lari

(57) ABSTRACT

An golf club head with a structure that improves the sound and reduces stress placed on the face upon impact with a golf ball is disclosed herein. In particular, the golf club head is an iron with a face having a rear protrusion, also referred to as a piston, with both forward and rearward facing surfaces. The piston is at least partially received within a receptacle provided in the body of the golf club head. The receptacle also includes a pair of bumpers, one of which interacts with the piston to improve the sound of the face upon impact with a golf ball at speeds at which an average golfer would swing the club head, and the other of which reduces the stress placed on the face when the club makes impact with a golf ball at high speeds.

20 Claims, 5 Drawing Sheets

(56) References Cited

U.S. PATENT DOCUMENTS

| | | | | |
|---|---|---|---|---|
| 2011/0034271 | A1* | 2/2011 | Wahl | A63B 53/047<br>473/342 |
| 2018/0028883 | A1* | 2/2018 | Morin | A63B 53/047 |

* cited by examiner

GOLF CLUB HEAD WITH FACE DAMPING AND STRESS-REDUCTION FEATURES

CROSS REFERENCES TO RELATED APPLICATIONS

The present application is a continuation-in-part of U.S. patent application Ser. No. 16/026,382, filed on Jul. 3, 2018, and issued on Jan. 8, 2019, as U.S. Pat. No. 10,173,109, which is a continuation of U.S. patent application Ser. No. 15/821,557, filed on Nov. 22, 2017, and issued on Aug. 7, 2018, as U.S. Pat. No. 10,039,965, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head, and particularly an iron head, with a structure that improves the sound of the striking face after impact with a golf ball at an average player's swing speed and also reduces stress in the striking face when it rebounds from a high speed impact with a golf ball.

Description of the Related Art

The prior art discloses various golf club heads having vibration damping inserts sandwiched or wedged between the golf club head striking face and another body portion of the club head. For example, U.S. Pat. No. 5,492,327 to Biafore discloses an iron with a damping material in a recess proximate a striking face, U.S. Pat. No. 6,743,117 to Gilbert discloses a dampening insert behind a strike face insert in an iron, and U.S. Pat. No. 9,168,437 to Roach et al. discloses an elastomeric insert attached to the back of the striking face of an iron.

In these prior art clubs, the damping effect of the insert occurs as soon as the striking face impacts a golf ball, such that the damping insert is compressed between the striking face and some other portion of the golf club head. This process damps vibrations in the striking face, but also reduces the coefficient of restitution (COR) of the face, thereby reducing face performance in exchange for better sound. These prior art structures also do not efficiently reduce stress placed on the face during high impact collisions, which can lead to face breakage. Therefore, there is a need for a vibration damping structure that improves sound and reduces stress placed on the striking face of the golf club head during high-speed impacts without negatively affecting performance.

BRIEF SUMMARY OF THE INVENTION

The present invention is directed to golf club head with a structure that produces a pleasing sound upon impact, regardless of the swing speed, and that also reduces the stress placed on the face when the golf club head makes impact with a golf ball at high speed.

One aspect of the present invention is a golf club head comprising a face component comprising a striking face, a rear surface, and a piston extending from the rear surface, a body comprising a top section, a bottom section, a heel side, a toe side, and a receptacle, and a front bumper, wherein the receptacle comprises a front chamber, a heel-side wall, a toe-side wall, a rear-side wall, a front-side wall, and a floor, wherein the front-side wall comprises a through-opening, wherein the face component is affixed to the body so that a first portion of the piston extends through the through-opening of the front-side wall, wherein a second portion of the piston is received within the front chamber of the receptacle, wherein the front bumper is disposed at least partially within the front chamber between the front-side wall and the second portion of the piston, and wherein no portion of the receptacle or the front bumper makes direct contact with the rear surface of the face component.

In some embodiments, the golf club head may further comprise a rear bumper, the receptacle may comprises a rear chamber defined by the rear-side wall and a divider wall, the divider wall may separate the rear chamber from the front chamber, and the rear bumper may be at least partially disposed with the rear chamber. In a further embodiment, the rear bumper may comprise a body and a protrusion, the divider wall may comprise a divider through-opening in communication with the front chamber, and the protrusion may extend into the divider through-opening. In these embodiments, the rear bumper may reduce stress in the striking face after the striking face impacts a golf ball. In any of these embodiments, the front bumper may damp vibration in the striking face after the striking face impacts a golf ball.

In other embodiments, the receptacle may extend from the bottom section of the body towards the top line section. In still other embodiments, the first portion of the piston may be a stem and the second portion of the piston may be a plate member, the stem may comprise a first end connected to the rear surface of the striking face and a second end opposite the first end, the stem may extend approximately perpendicular to the rear surface, the plate member may be connected to the second end of the stem, and the plate member may extend approximately perpendicular to the stem and parallel with the rear surface of the striking face. In any of these embodiments, the face component may be a face cup comprising an upper flange and a lower flange, the upper flange may be welded to the top section, and the lower flange may be welded to the bottom section. In these embodiments, each of the body and the face component may be composed of a metal alloy material, and the first bumper may be composed of a graphene material.

Another aspect of the present invention is an iron-type golf club head comprising a metal body comprising a top section, a bottom section, a hosel disposed at a heel side, a toe side opposite the heel side, and a receptacle, a metal face component comprising a striking face surface, a rear face surface opposite the striking face surface, an upper flange, a lower flange, and a piston extending from the rear face surface, and a rear bumper, wherein the piston comprises a stem and a plate member, wherein the stem comprises a first end connected to the rear face surface and a second end opposite the first end, wherein the stem extends approximately perpendicular to the rear face surface, wherein the plate member is connected to the second end of the stem, wherein the receptacle is at least partially defined by a front-side wall, a rear-side wall, a toe-side wall, a heel-side wall, and a floor, wherein the receptacle comprises a front chamber and a rear chamber separated by a divider wall, wherein the front-side wall comprises a first through-opening, wherein the divider wall comprises a second through-opening so that the front chamber is in communication with the rear chamber, wherein the rear bumper comprises a bumper body and a protrusion, wherein the bumper body is disposed within the rear chamber and the protrusion extends into the second through-opening, wherein the face component is affixed to the body, wherein the stem extends through the first through-opening and the plate member is disposed within the front chamber, and wherein the rear bumper reduces stress in the striking face after the striking face impacts a golf ball.

In some embodiments, the iron-type golf club head may further comprise a front bumper composed of a non-metal material, the front bumper may be disposed within the front chamber between the front-side wall and the plate member, and the front bumper may damp vibration in the striking face after the striking face impacts a golf ball. In a further embodiment, when the golf club head is at address, a first gap may be disposed between the plate member and the front bumper and a second gap may be disposed between the plate member and the divider wall. In these embodiments, the front bumper may at least partially encircle the stem. In other embodiments, a front gap may be disposed between the front-side wall of the receptacle and the rear face surface, and no portion of the receptacle may make direct contact with rear face surface during impact with a golf ball. In any of these embodiments, the stem may extend from the rear face surface at a point located below a geometric face center of the rear face surface measured along a vertical Z axis. Also, in any of these embodiments, the rear bumper may be composed of a graphene material.

Yet another aspect of the present invention is an iron-type golf club head comprising a face component comprising a striking face, a rear face surface, and a piston extending from the rear face surface, a body comprising a top section, a bottom section, a heel side, a toe side, and a receptacle, a front bumper, and a rear bumper, wherein the receptacle comprises a heel-side wall, a toe-side wall, a rear-side wall, a front-side wall, and a floor, wherein the front-side wall comprises a through-opening, wherein the face component is affixed to the body so that a first portion of the piston extends through the through-opening of the front-side wall, wherein a second portion of the piston is received within the front chamber of the receptacle, wherein the front bumper is disposed at least partially within the receptacle between the front-side wall and the second portion of the piston, wherein the rear bumper is disposed at least partially within the receptacle between the second portion of the piston and the rear-side wall, wherein the front bumper damps vibration in the striking face after the striking face impacts a golf ball, and wherein the rear bumper reduces stress in the striking face after the striking face impacts a golf ball.

In some, further embodiments, each of the front bumper and the rear bumper may be composed of a graphene material. In other embodiments, the first portion of the piston may be a stem and the second portion of the piston may be a plate member, the stem may extend from and approximately perpendicular to the rear face surface, and the plate member may extend from and approximately perpendicular to the stem. In any of these embodiments, a front gap may be disposed between the front-side wall of the receptacle and the rear face surface, a first gap may be disposed between the plate member and the front bumper when the golf club head is at address, a second gap may be disposed between the plate member and the rear bumper when the golf club head is at address, and no portion of the receptacle or the front or rear bumpers may make direct contact with rear face surface during impact with a golf ball.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
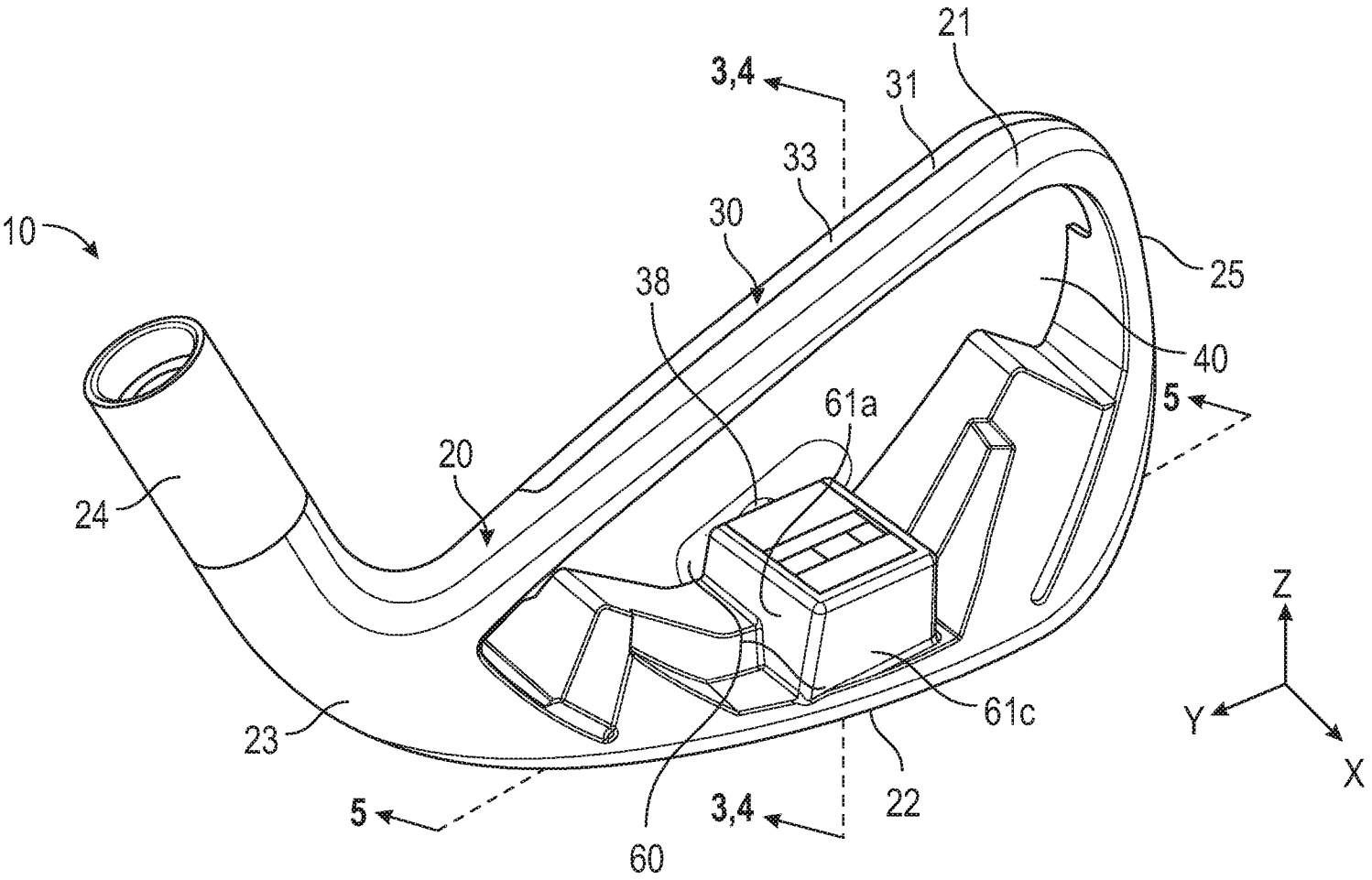
FIG. 1 is a rear elevational view of the preferred embodiment of the golf club head of the present invention.
Figure 2:
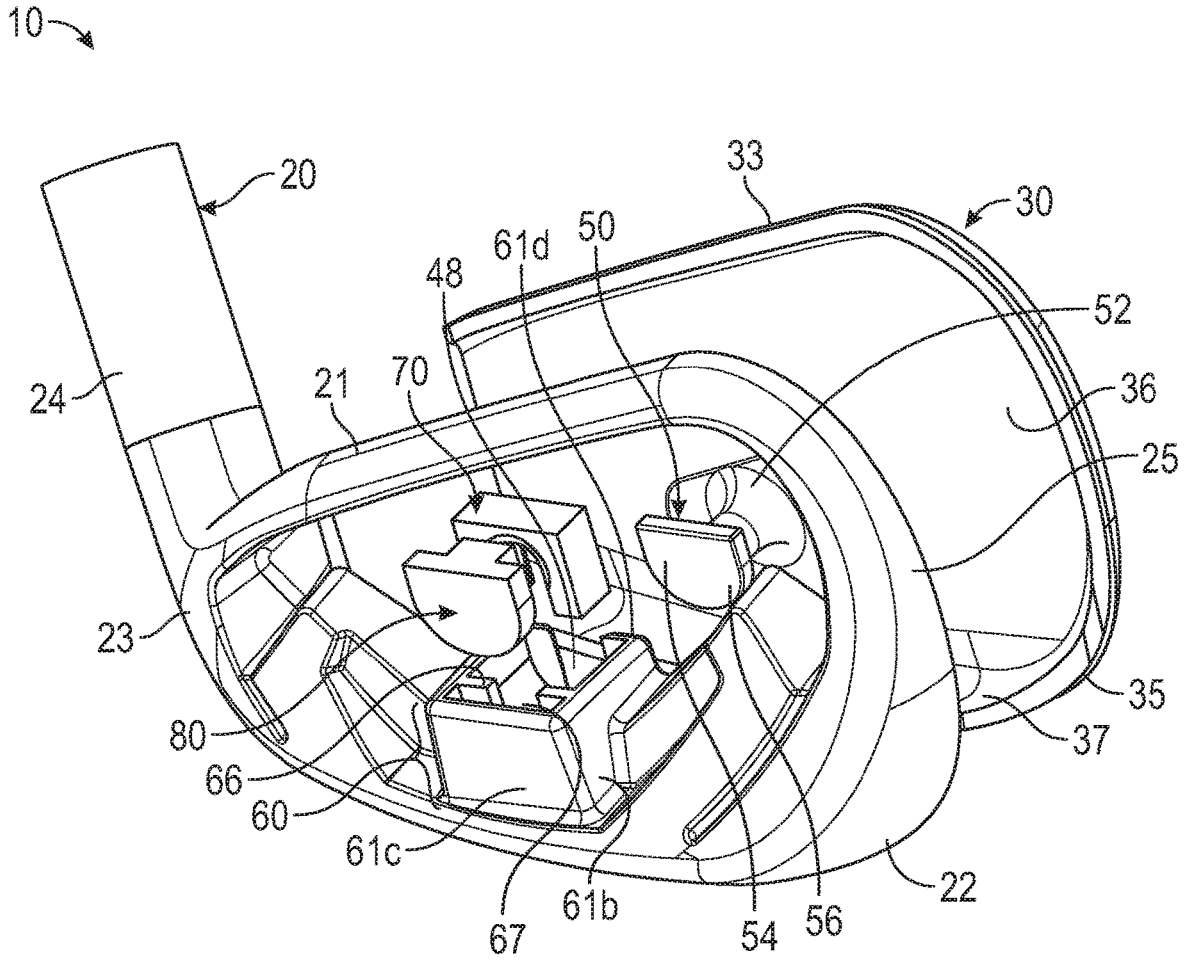
FIG. 2 is an exploded view of the golf club head shown in FIG. 1.
Figure 3:
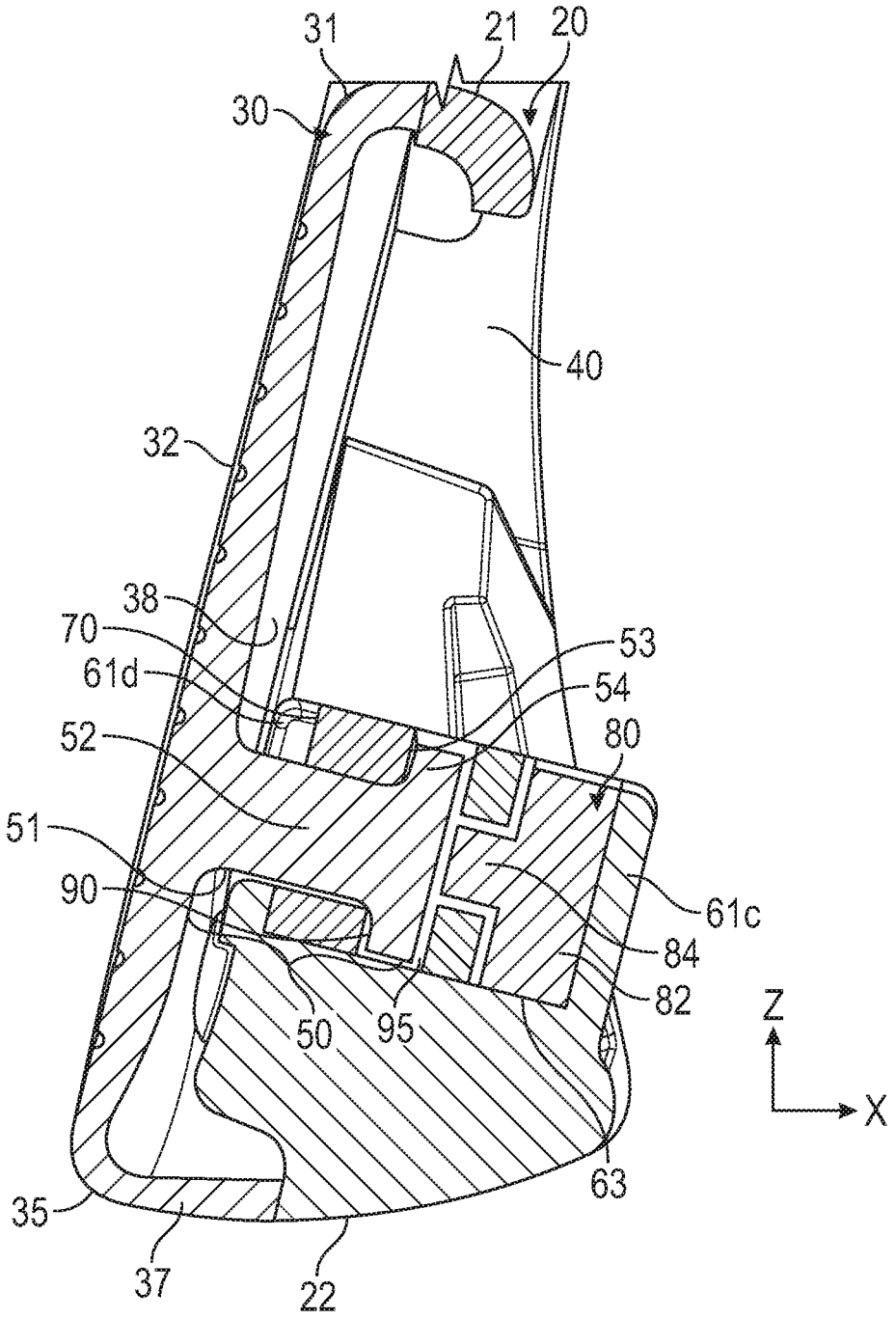
FIG. 3 is a cross-sectional view of the golf club head shown in FIG. 1 along lines 3-3.
Figure 4:
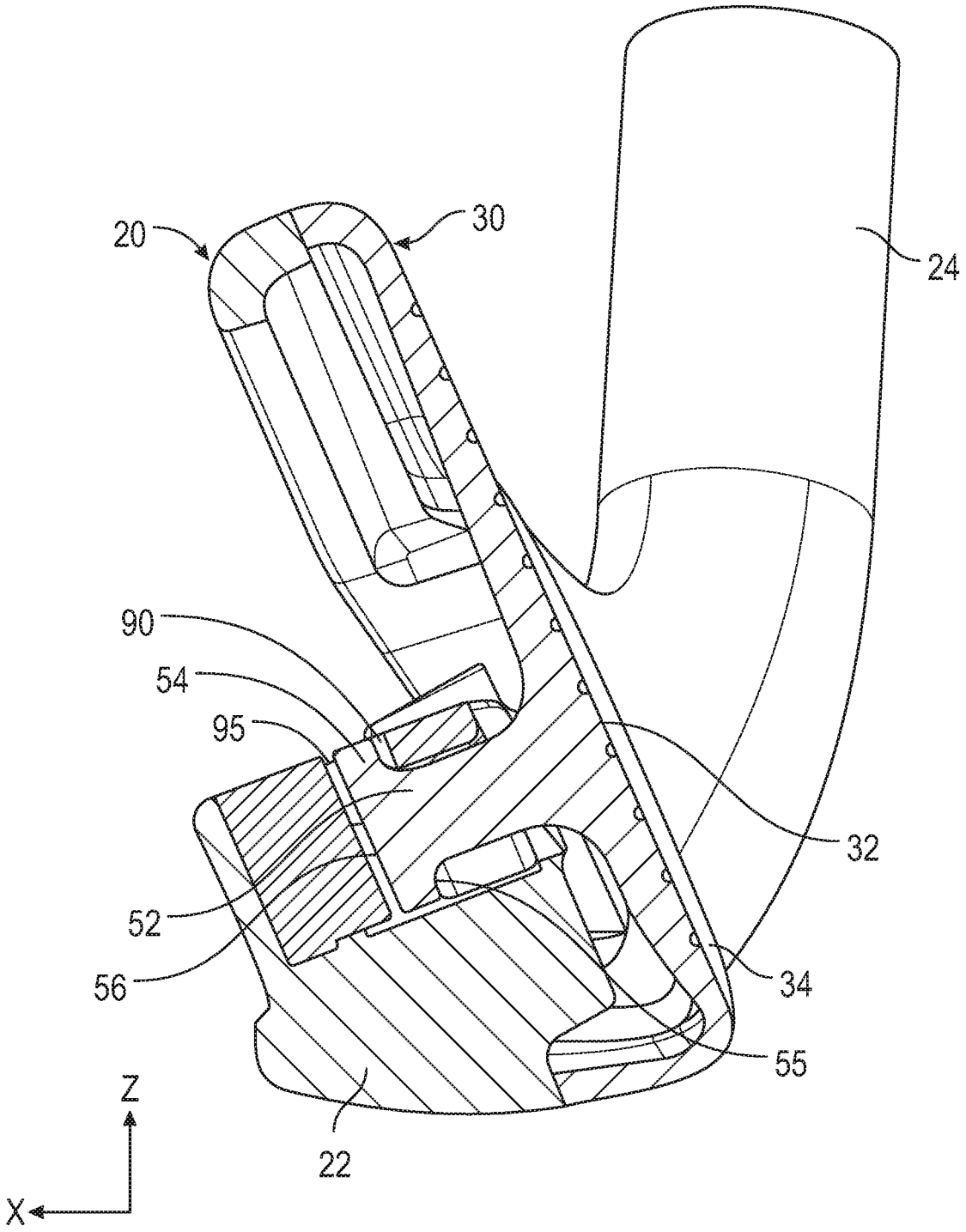
FIG. 4 is a cross-sectional view of the golf club head shown in FIG. 1 along lines 4-4.
Figure 5:
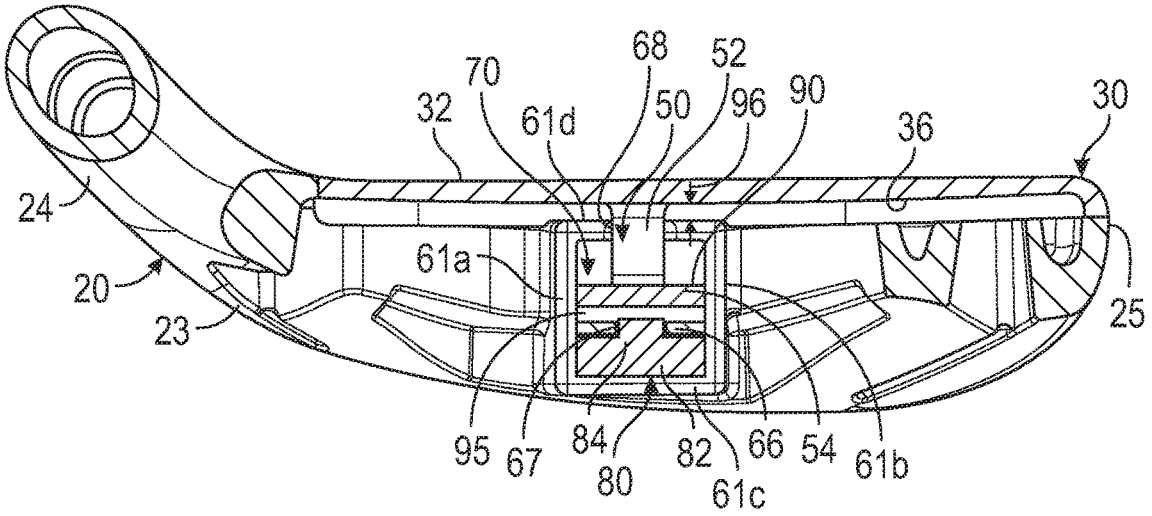
FIG. 5 is a cross-sectional view of the golf club head shown in FIG. 1 along lines 5-5.

The golf club head of the present includes a structure designed to reduce the amplitude and duration of the sound made by the striking face after the golf club head impacts a golf ball, known as damping, without impeding the performance of the striking face with respect to ball velocity. The structure also is designed reduce the stress placed upon the striking face when it makes impact with a golf ball at higher speeds.

A preferred embodiment of the present invention is shown in FIGS. 1-6. The golf club head 10 comprises a body 20 having a top line section 21, a bottom section 22, a heel side 23 where a hosel 24 connects with the body 20, and a toe side 25, and a face component 30 comprising a striking face 32 with a front striking surface 34, a rear surface 36 opposite the front striking surface 34, an upper flange 33 extending from an upper edge 31 of the striking face 32, and a lower flange 37 extending from a lower edge 35 of the striking face 32. The striking face 32 has a geometric face center 38 and preferably comprises a variable thickness pattern. When the face component 30 is affixed to the body 20 by welding or otherwise connecting the upper flange 33 to the top line section 21 and the lower flange 37 to the bottom section 22, the two parts define a hollow, rear-facing cavity 40.

Figure 6:
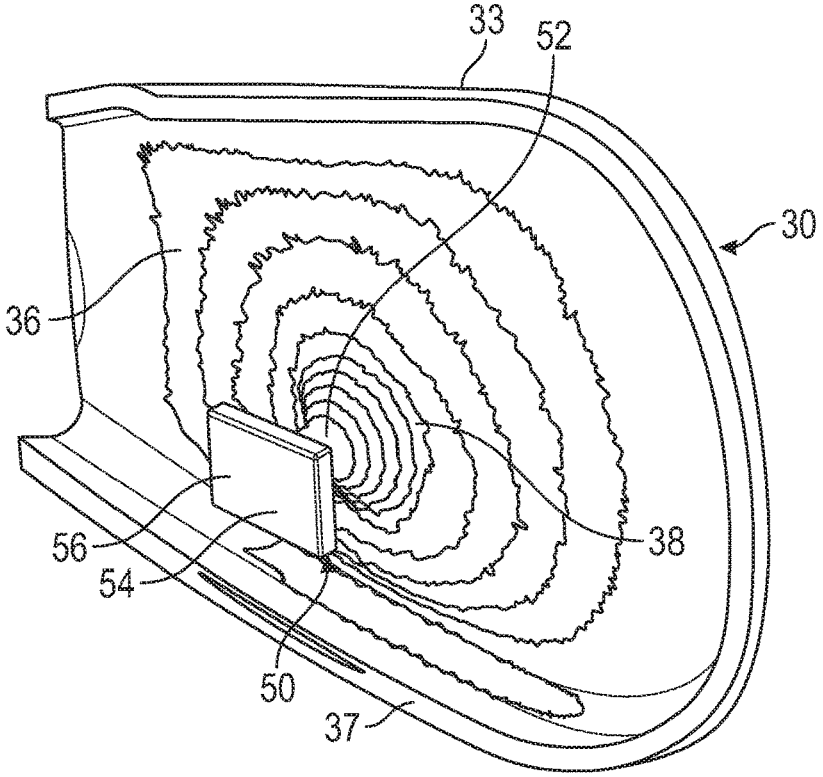
FIG. 6 is a rear perspective view of the face component of the golf club head shown in FIG. 1.

The face component 30 also includes a piston 50 comprising a load transfer member 52, also referred to herein as a stem, having a first end 51 extending from or affixed to the rear surface 36 of the striking face 32 and a second end 53 affixed to a plate member 54, which extends perpendicular to the stem 52 and approximately parallel with the rear surface 36 of the striking face 32. The plate member 54 has a forward facing surface 55 and a rearward facing surface 56. The piston 50 preferably is integrally manufactured (e.g., cast, formed, forged) with the face component 30 to ensure structural integrity, though it may be formed separately and attached to the face component 30 via welding, gluing, or other processes known in the art. The stem 52 and plate member 54 preferably are integrally formed with one another, but may in alternative embodiments be welded or otherwise affixed to one another. The piston 50 preferably extends from a spot at or below the geometric face center 38 measured along a vertical Z axis, as shown in FIG. 6.

The body 20 comprises a receptacle 60 that aligns with, and receives, the piston 50. The receptacle 60, which preferably is integrally formed with the body 20 so that it extends from the bottom section 22 of the body, comprises a front chamber 62 sized to receive the stem 52 of the piston 50, a rear chamber 64 sized to receive the plate member 54 of the piston 50, and a divider wall 66 that partially divides the front and rear chambers 62, 64. The divider wall 66 has a through-opening 67 that connects the front and rear chambers 62, 64 so they communicate with one another. The receptacle 60 is defined by heel-side, toe-side, rear-side, and front-side walls 61*a*, 61*b*, 61*c*, 61*d* and a floor 63. The front-side wall 61*d* also includes a through-opening 68 sized to receive the stem 52 of the piston 50.

A first bumper 70 comprising a through-opening or slot 72 sized to receive and at least partially encircle the stem 52 is disposed in the front chamber 62. A second bumper 80 comprising a body portion 82 and a protrusion 84 extending approximately perpendicular from the body portion 82 is disposed in the rear chamber 64 so that the protrusion 84 extends through the through-opening 67 in the divider wall 66 and at least partially into the front chamber 62.

When the golf club head 10 is fully assembled and in a resting state (e.g., at address), the bumpers 70, 80 are in their uncompressed states; a first gap 90 is disposed between the forward facing surface 55 of the piston 50 and the first bumper 70, and a second gap 95 is disposed between the rearward facing surface 56 and the divider wall 66 and protrusion 84 of the second bumper 80. Upon impact with a golf ball, the striking face 32, and thus the piston 50, moves rearwards, and then flexes forwards. When the striking face 32 flexes forwards, the forward facing surface 55 of the plate member 54 comes into contact with the first bumper 70, thereby damping the amplitude and duration of the sound made by the face component 30 after the ball has left the striking face 32.

If the golf club head 10 is swung at a high speed by a more powerful or experienced golfer, the striking face 32 will flex further in the rearward direction, such that the piston 50 closes the first gap 90 and the rearward facing surface 56 of the plate member 54 comes into contact with the protrusion 84 of the second bumper 80. The second bumper 80 presses against the rearward facing surface 56 of the plate member and resists the force of the flexure, thereby supporting the striking face 32 and reducing the likelihood of breakage during a high speed impact. This structure allows for selective stress reduction in the striking face 32 depending on the skill and power of the golfer.

The divider wall 66 helps to maintain the gaps 90, 95 and retain the bumpers 70, 80 within their respective portions of the receptacle 60. At no point during address, swing, or impact does the receptacle 60 make direct contact with the rear surface 36 of the striking face—a front gap 96 is maintained between the rear surface 36 and the front side wall 61*d* by the piston 50 and bumper 70, 70 system.

In each of the embodiments disclosed herein, the bumpers 70, 80 preferably are composed of a graphene material, though in alternative embodiments they may be composed of an elastic material such as rubber. Each of the body 20 and the face component 30 is composed of one or more metal alloy materials, such as stainless steel or titanium alloy. A medallion or other decorative feature (not shown) may also be affixed to the rear surface 36 of the striking face 32.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a face component comprising a striking face, a rear surface, and a piston extending from the rear surface;

a body comprising a top section, a bottom section, a heel side, a toe side, and a receptacle; and a front bumper, wherein the receptacle comprises a front chamber, a heel-side wall, a toe-side wall, a rear-side wall, a front-side wall, and a floor, wherein the front-side wall comprises a through-opening, wherein the face component is affixed to the body so that a first portion of the piston extends through the through-opening of the front-side wall, wherein a second portion of the piston is received within the front chamber of the receptacle, wherein the front bumper is disposed at least partially within the front chamber between the front-side wall and the second portion of the piston, and wherein no portion of the receptacle or the front bumper makes direct contact with the rear surface of the face component.

2. The golf club head of claim 1, further comprising a rear bumper, wherein the receptacle comprises a rear chamber defined by the rear-side wall and a divider wall, wherein the divider wall separates the rear chamber from the front chamber, and wherein the rear bumper is at least partially disposed with the rear chamber.

3. The golf club head of claim 2, wherein the rear bumper comprises a body and a protrusion, wherein the divider wall comprises a divider through-opening in communication with the front chamber, and wherein the protrusion extends into the divider through-opening.

4. The golf club head of claim 3, wherein the rear bumper reduces stress in the striking face after the striking face makes impact with a golf ball.

5. The golf club head of claim 1, wherein the front bumper damps vibration in the striking face after the striking face impacts a golf ball.

6. The golf club head of claim 1, wherein the receptacle extends from the bottom section of the body towards the top line section.

7. The golf club head of claim 1, wherein the first portion of the piston is a stem and the second portion of the piston is a plate member, wherein the stem comprises a first end connected to the rear surface of the striking face and a second end opposite the first end, wherein the stem extends approximately perpendicular to the rear surface, wherein the plate member is connected to the second end of the stem, and wherein the plate member extends approximately perpendicular to the stem and parallel with the rear surface of the striking face.

8. The golf club head of claim 1, wherein the face component is a face cup comprising an upper flange and a lower flange, wherein the upper flange is welded to the top section, and wherein the lower flange is welded to the bottom section.

9. The golf club head of claim 1, wherein each of the body and the face component is composed of a metal alloy material, and wherein the first bumper is composed of a graphene material.

10. An iron-type golf club head comprising:

a metal body comprising a top section, a bottom section, a hosel disposed at a heel side, a toe side opposite the heel side, and a receptacle;

a metal face component comprising a striking face surface, a rear face surface opposite the striking face surface, an upper flange, a lower flange, and a piston extending from the rear face surface; and a rear bumper, wherein the piston comprises a stem and a plate member, wherein the stem comprises a first end connected to the rear face surface and a second end opposite the first end, wherein the stem extends approximately perpendicular to the rear face surface, wherein the plate member is connected to the second end of the stem, wherein the receptacle is at least partially defined by a front-side wall, a rear-side wall, a toe-side wall, a heel-side wall, and a floor, wherein the receptacle comprises a front chamber and a rear chamber separated by a divider wall, wherein the front-side wall comprises a first through-opening, wherein the divider wall comprises a second through-opening so that the front chamber is in communication with the rear chamber, wherein the rear bumper comprises a bumper body and a protrusion, wherein the bumper body is disposed within the rear chamber and the protrusion extends into the second through-opening, wherein the face component is affixed to the body, wherein the stem extends through the first through-opening and the plate member is disposed within the front chamber, and wherein the rear bumper reduces stress in the striking face after the striking face impacts a golf ball.

11. The iron-type golf club head of claim 10, further comprising a front bumper composed of a non-metal material, wherein the front bumper is disposed within the front chamber between the front-side wall and the plate member, and wherein the front bumper damps vibration in the striking face after the striking face impacts a golf ball.

12. The iron-type golf club head of claim 11, wherein when the golf club head is at address, a first gap is disposed between the plate member and the front bumper and a second gap is disposed between the plate member and the divider wall.

13. The iron-type golf club head of claim 11, wherein the front bumper at least partially encircles the stem.

14. The iron-type golf club head of claim 10, wherein a front gap is disposed between the front-side wall of the receptacle and the rear face surface, and wherein no portion of the receptacle makes direct contact with rear face surface during impact with a golf ball.

15. The iron-type golf club head of claim 10, wherein the stem extends from the rear face surface at a point located below a geometric face center of the rear face surface measured along a vertical Z axis.

16. The iron-type golf club head of claim 10, wherein the rear bumper is composed of a graphene material.

17. An iron-type golf club head comprising:

a face component comprising a striking face, a rear face surface, and a piston extending from the rear face surface;

a body comprising a top section, a bottom section, a heel side, a toe side, and a receptacle;

a front bumper; and a rear bumper, wherein the receptacle comprises a front chamber, a heel-side wall, a toe-side wall, a rear-side wall, a front-side wall, and a floor, wherein the front-side wall comprises a through-opening, wherein the face component is affixed to the body so that a first portion of the piston extends through the through-opening of the front-side wall, wherein a second portion of the piston is received within the front chamber of the receptacle, wherein the front bumper is disposed at least partially within the receptacle between the front-side wall and the second portion of the piston, wherein the rear bumper is disposed at least partially within the receptacle between the second portion of the piston and the rear-side wall, wherein the front bumper damps vibration in the striking face after the striking face impacts a golf ball, and wherein the rear bumper reduces stress in the striking face after the striking face impacts a golf ball.

18. The iron-type golf club head of claim 17, wherein each of the front bumper and the rear bumper is composed of a graphene material.

19. The iron-type golf club head of claim 17, wherein the first portion of the piston is a stem and the second portion of the piston is a plate member, wherein the stem extends from and approximately perpendicular to the rear face surface, and wherein the plate member extends from and approximately perpendicular to the stem.

20. The iron-type golf club head of claim 19, wherein a front gap is disposed between the front-side wall of the receptacle and the rear face surface, wherein a first gap is disposed between the plate member and the front bumper when the golf club head is at address, wherein a second gap is disposed between the plate member and the rear bumper when the golf club head is at address, and wherein no portion of the receptacle or the front or rear bumpers makes direct contact with rear face surface during impact with a golf ball.

* * * * *